United States Patent [19]

Catrambone

[11] Patent Number: 4,508,223

[45] Date of Patent: Apr. 2, 1985

[54] PREFORMED POT COVER PACKAGE

[75] Inventor: Joel Catrambone, Rancho Cucamonga, Calif.

[73] Assignee: A. J. Sparks & Company, Grand Rapids, Mich.

[21] Appl. No.: 551,108

[22] Filed: Nov. 14, 1983

[51] Int. Cl.[3] ..... B65D 85/50; B65D 85/52

[52] U.S. Cl. ..... 206/423; 206/485; 206/560

[58] Field of Search ..... 206/423, 476, 489, 490, 206/486, 560, 485

[56] References Cited

U.S. PATENT DOCUMENTS

| | | | |
|---|---|---|---|
| 1,606,523 | 11/1926 | Gardner | 206/423 |
| 1,954,006 | 4/1934 | Wolf | 206/423 |
| 2,217,454 | 10/1940 | Pfeiffer | 206/423 |
| 2,358,295 | 9/1944 | Bacigacupi | 206/423 |
| 2,736,138 | 2/1956 | Buttgry | 206/423 |
| 3,418,194 | 12/1968 | Loftice | 206/423 |
| 3,606,004 | 9/1971 | Fruehwirth | 206/423 |

FOREIGN PATENT DOCUMENTS

| | | | |
|---|---|---|---|
| 2303735 | 10/1976 | France | 206/423 |
| 715219 | 9/1954 | United Kingdom | 206/423 |
| 721143 | 12/1954 | United Kingdom | 206/423 |

*Primary Examiner*—Joseph Man-Fu Moy

*Attorney, Agent, or Firm*—Price, Heneveld, Huizenga & Cooper

[57] ABSTRACT

A container insert slidably receives a plurality of columns of nested preformed pot covers in slots formed in the insert which is spaced from the sides of the container in which it is positioned. The bow of the pot covers project on one side of the insert panel with the preformed cover on the opposite side thereby utilizing the bow itself as a support for holding a plurality of preformed covers in spaced relationship with respect to each other for shipment.

3 Claims, 3 Drawing Figures

PREFORMED POT COVER PACKAGE

BACKGROUND OF THE INVENTION

The present invention pertains to a packaging system for relatively lightweight but bulky and fragile articles, and particularly, for preformed pot covers.

In the past, typically florists wrap potted plants with flat sheets of decorative foil and/or preformed pot cover subsequently tie ribbons around the cover to hold it in place on the pot. Such materials, typically, would be shipped to the florist either in sheets of foil or other decorative wrapping material and rolls of ribbon or in some cases, rolls of wrapping material which is subsequently cut. Thus, the materials employed by the florist in providing a decorative cover for the potted plants are relatively easily packaged for shipment.

With the development of the preformed pot cover which is the subject matter of a copending patent application, entitled PREFORMED POT COVER, filed concurrently herewith and commonly assigned; the resultant cover is a very lightweight, but bulky and fragile article. Although shaped to permit nesting of several preformed pot covers; they do not readily permit the packaging or more than one column of such nested pot covers in a single package. This is due to the inherent fragility of the bows, ribbons and the preformed foil which forms the cover. It is desired, therefore, to package and ship as many preformed pot covers as possible in a single package and at the same time prevent damage to the fragile articles during shipment.

SUMMARY OF THE PRESENT INVENTION

The system of the present invention achieves the desired results by providing a container insert which slidably receives a plurality of columns or column (1) of nested preformed pot covers in slots formed in the insert and spaced from the sides of the container in which it is positioned. The bow of the pot cover extends on one side of the planar insert with the cover on the opposite side thereby utilizing the bow itself as a support for holding a plurality of preformed covers in spaced relationship with respect to each other for shipment.

With such a system, a relatively large number of preformed pot covers can be densely packed in a container for shipment without injury.

These and other features, objects and advantages of the present invention will become apparent upon reading the following description thereof together with reference to the accompanying drawings in which:

DETAILED DESCRIPTION OF THE PREFERRED EMBODIMENT

Figure 2:
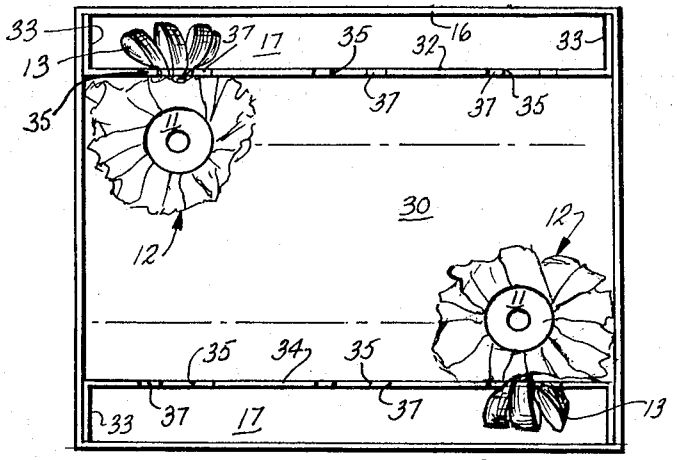
FIG. 2 is a top plan view showing the support member inserted into the container.

Referring to the Figures, the packaging system includes a package insert 10 for supporting a plurality of preformed pot covers 12 which can be substantially identical to those described in the above identified copending patent application, the disclosure of which is incorporated herein by reference. Insert 10 fits within a conventional, generally rectilinear, corrugated cardboard carton 14 having four vertically extending sidewalls 16, a floor 17 (FIG. 2) and top cover flaps 18 which are employed to close the carton once the insert loaded with columns of column (1) of nested covers has been positioned therein. In the embodiment illustrated, the insert 10 can hold six columns, each consisting of four nested preformed covers 12, as seen in FIG. 1.

Figure 3:
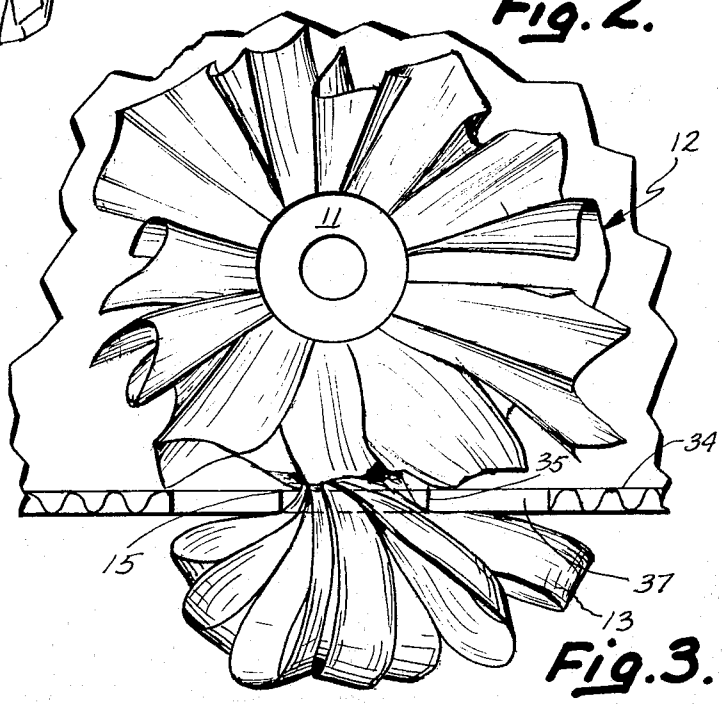
FIG. 3 is an enlarged, fragmentary, cross-sectional view taken along section line III—III of FIG. 1.

The nature of the preformed, preshaped pot covers 12 are such that each pot cover 12 includes an extending portion 13 comprising, in the preferred embodiment, the bow which has a necked down area 15 (FIG. 3) where it joins the body of the ribbon surrounding the preshaped cover. The extending portion of the item to be packaged is utilized in connection with the novel package insert 10 to provide the desired protective packaging. In the preferred embodiment, the insert 10 includes a floor spacer panel 30 and integral, upwardly extending side panels 32 and 34. Each of the side panels have end flaps 33 at opposite ends thereof for supporting the side panels 32 and 34 in spaced relationship with respect to the sides 16 of carton 14, as best seen in FIG. 2. Thus, the length of floor panel 30 is substantially the same as that of floor 17 of carton 14 while the width is significantly less such that the side panels 32 and 34 are spaced from the sides 16 of the carton. The outwardly extending flaps 33 serve to provide the desired spacing and support for the side panels with respect to the interior sides of the container into which the insert is positioned.

In order to receive the narrowed portion 15 connecting the bow 13 to the body of the pot cover 12, each side panel includes slot means 35 and, in the preferred embodiment, each panel includes three, equally spaced slots 35 extending downwardly from the top edge of the side panels remote from floor 30. To facilitate insertion of the pot covers, the mouth of the slots adjacent the top edge of the side panels are outwardly divergent at 37, as best seen in FIG. 1, to provide a larger opening at the top of the slot than the narrowed portion extending downwardly approximately 80% of the height of the sides of panels 32 and 34.

Figure 1:
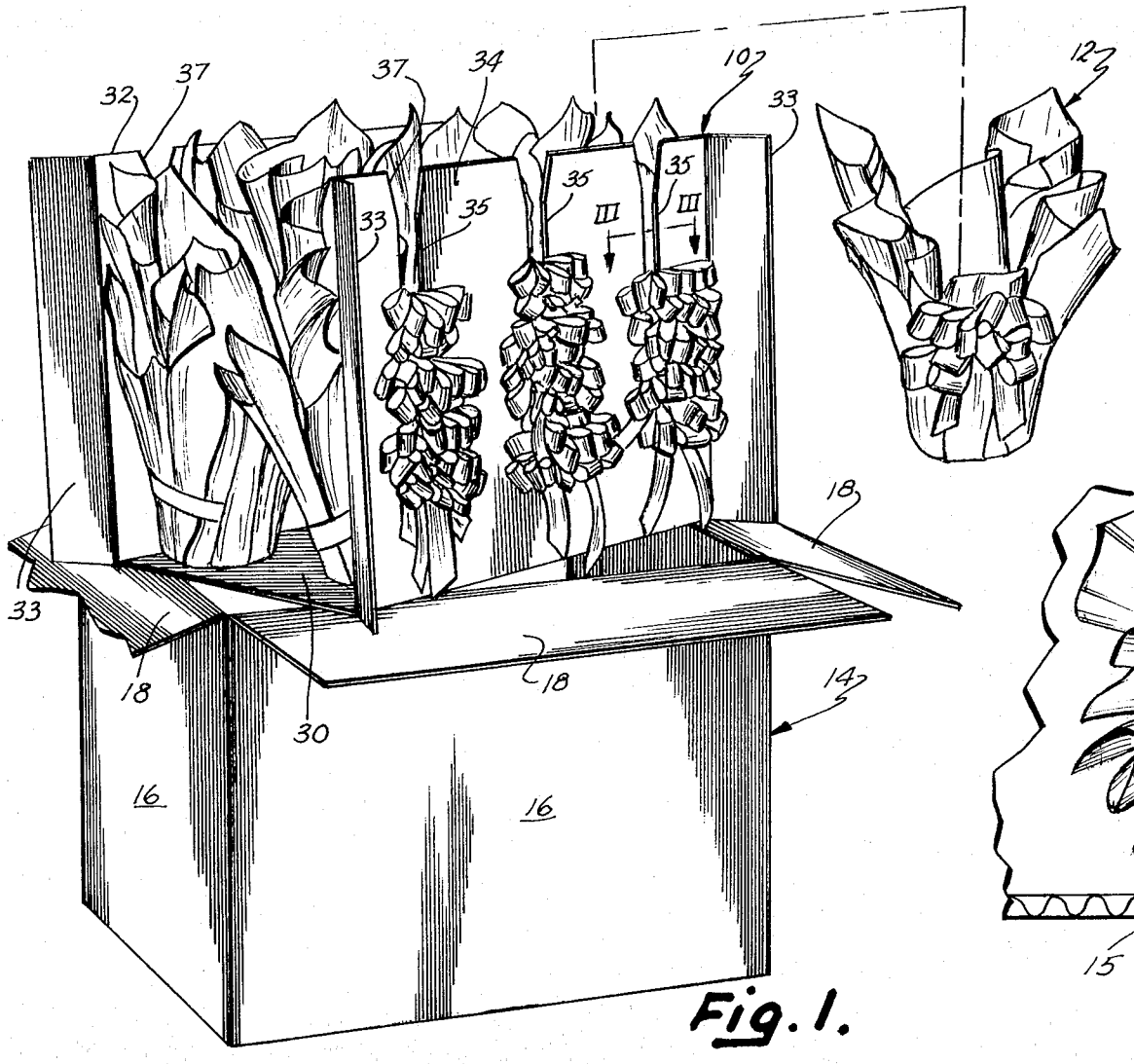
FIG. 1 is an exploded, perspective view of a package embodying the present invention.

In the preferred embodiment, illustrated in the drawings, in which each of the preshaped pot covers 12 include a supporting disk-shaped floor member 11 (FIG. 3), at least four such pot covers can be nested, as seen in FIG. 1, to define a vertically extending column which can subsequently be inserted downwardly through the wider mouth 37 of slots 35 with the bow 13 extending on one side of panel 34 and the body of the pot cover 12 extending on the opposite side. Thus, the plurality of vertically spaced bows are held by edges of the slot 35 as well as the opposite sides of panel 34 for holding the column of nested pot covers in spaced relationship in generally vertical alignment with respect to neighboring columns of nested pot covers on the same wall and to columns similarly secured to wall 32. This construction not only protects the integrity of the bows and the relatively fragile preshaped foil wrapping defining the pot cover 12, it also provides a relatively dense pack of several such covers for shipment.

Although the embodiment shown provides a U-shaped insert with a floor and two sidewalls, the insert may comprise one or more single slotted panels, such as panel 32, configured to support one or more columns of pot covers in spaced, protective relationship within a container. The dimensions of the insert 10 and associated carton 14, can be varied to package a greater or fewer number of pot covers. Also, in some embodiments, it may desired to structure the insert such that the bows and not the bodies of the pot covers extend between the upwardly extending sidewalls 32 and 34 with the bodies of the pot covers on the outside of such walls. In such case, the width of floor 30 would be reduced and the length of flaps 33 increased to reverse the orientation of the pot covers with respect to the supporting insert.

These and other modifications to the preferred embodiment will, however, fall within the spirit and scope of the present invention as defined by the appended claims.

The embodiments of the invention in which an exclusive property or privilege is claimed are defined as follows:

1. In a package supporting a plurality of preformed pot covers nested in vertical columns, each of said pot covers having a body portion with a bow attached thereto, said package comprising:

a container having a floor, sides and a cover;

at least one panel for positioning in said container, wherein said panel includes a floor member and two side members attached thereto and extending upwardly from opposite sides thereof, said panel further including a plurality of elongated, spaced, parallel, vertically extending slots located in said side members thereof, said slots receiving the bow on one side thereof and the body on the other side thereof, whereby each of said slots support a vertical column of nested pot covers and said panel supports a plurality of vertically extending columns of nested pot covers in spaced relationship along said floor member; and spacing means connected to said panel for positioning said side members a predetermined distance from the sides of said container.

2. The package as defined in claim 1 wherein each of said slots includes an outwardly diverging portion at the top of said side members to facilitate insertion of said pot covers therein.

3. A package for supporting a plurality of preformed pot covers as recited in claim 2 wherein said spacing means comprises a plurality of end flaps which are attached to said side members and extend outwardly therefrom.

* * * * *